US007165946B2

(12) United States Patent
Nava et al.

(10) Patent No.: US 7,165,946 B2
(45) Date of Patent: Jan. 23, 2007

(54) LOW-MID TURBINE TEMPERATURE ABRADABLE COATING

(75) Inventors: Irene L. Nava, Chula Vista, CA (US); Michael A. Coe, San Diego, CA (US)

(73) Assignee: Solar Turbine Incorporated, San Diego, CA (US)

( * ) Notice: Subject to any disclaimer, the term of this patent is extended or adjusted under 35 U.S.C. 154(b) by 115 days.

(21) Appl. No.: 10/872,609

(22) Filed: Jun. 21, 2004

(65) Prior Publication Data

US 2005/0281668 A1 Dec. 22, 2005

(51) Int. Cl.
*F01D 5/14* (2006.01)

(52) U.S. Cl. ..... 416/241 R; 416/241 A; 416/224

(58) Field of Classification Search ..... 416/224, 416/229 R, 241 R, 241 A, 241 B
See application file for complete search history.

(56) References Cited

U.S. PATENT DOCUMENTS 3,879,831 A 4/1975 Rigney et al.
5,434,210 A 7/1995 Rangaswamy et al.
5,536,022 A 7/1996 Sileo et al.
5,780,116 A 7/1998 Sileo et al.
6,533,285 B1 3/2003 Nava et al.

FOREIGN PATENT DOCUMENTS

EP 0 361 709 B1 4/1990
EP 0 487 273 B1 6/1995
EP 0 725 842 B1 8/1996

*Primary Examiner*—Edward K. Look
*Assistant Examiner*—Dwayne J White
(74) *Attorney, Agent, or Firm*—Liell & McNeil

(57) ABSTRACT

In order to minimize a clearance between a turbine and its housing, and thus, improve the efficiency of a turbine engine, an abradable coating can be applied to an inner surface of the turbine housing. However, there are no known abradable coatings that can be applied to a housing that is subjected to temperatures between 950–1500° F. for extended periods of time. The apparatus of the present disclosure includes a housing including a 950–1500° F. section in which at least one rotating blade row is positioned. The rotating blades and the 950–1500° F. section each includes a surface being comprised of a relatively non-abradable material. The surface of the housing comprised of the relatively non-abradable material is covered by a 950–1500° F. relatively abradable coating that includes a metallic matrix and at least one of a thermoplastic and dry lubricant. The metallic matrix is 55–85% of the coating by volume.

20 Claims, 2 Drawing Sheets

LOW-MID TURBINE TEMPERATURE ABRADABLE COATING

TECHNICAL FIELD

This disclosure relates generally to apparatuses including abradable coatings, and more specifically to abradable coatings subjected to temperatures between 950–1,500° F.

BACKGROUND

Gas turbine engines generally include a compressor section, a combustion section and a turbine section. A compressor within the compressor section and a turbine within the turbine section each can include a plurality of rotors attached to a central rotating shaft. The rotors include a plurality of blades that project radially therefrom. Both the compressor and turbine are encased in separate cylindrical housings, creating a clearance between the rotating blades and each housing. The clearance between the blades and the housings should be designed in order to assure that the blades, when rotating, do not make contact with the housings. Because the coefficient of expansion of the blades may differ from that of the housings, the clearance between the blades and the housing must be sufficiently large to accommodate the expanded rotating blades at higher temperatures and loads. Thus, at lower temperatures and loads, the clearance between the blades and the housings may be excessively large. The large clearance will decrease the efficiency of the turbine engine by allowing the gases and/or compressed air to flow around the blades at lower temperatures and loads.

Abradable coatings have often been used to increase the efficiency of turbine engines by limiting the flow area around the turbine and compressor blades. The clearance between the blades and the housings can be reduced by applying the abradable coating to an inner surface of the housings. The clearance can be designed such that when the turbine engine is operating at higher temperatures and loads during a break in period, the outer tips of the blades will make contact with the abradable coating of the housings. The contact will cause the abradable coating to abrade away until there is no contact between the outer tips of the blades and the housings. Thus, the clearance between the blades and the housings will be only as large as necessary to accommodate the blades at high temperatures, thereby increasing efficiency by limiting the air flow around the turbine and/or compressor blades, even at lower temperatures and loads.

Although the abradable coatings have been able to increase turbine engine efficiency, an abradable coating that can be applied to turbine blades operating in low to mid temperature turbine stages of a land-based turbine engine has remained elusive. Often, turbines include rows, or stages, of rotating turbine blades that are subjected to different temperatures. For example, a low temperature stage of the turbine may be subjected to temperatures between 950–1300° F., a mid-temperature stage of the turbine may be subjected to temperatures between 1300–1500° F., and a high temperature stage of the turbine may be subjected to temperatures above 1500° F. Because at each stage, the turbine operates within a different temperature range, an abradable coating that works in one stage of the turbine may not provide the oxidation resistance and structural integrity required for a higher temperature stage.

It is known in the art that abradable coatings, such as the coating, described in U.S. Pat. No. 5,434,210 issued to Rangaswamy et al. on Jul. 18, 1995, can be made from a metallic matrix, a thermoplastic and a dry lubricant. However, it is still unknown what percentages of the matrix-forming component, the solid lubricant and the thermoplastic that can provide abradability while maintaining structural integrity and oxidation resistance at temperatures between 950–1500° F. for extended periods of time. For instance, 80%, by volume, of an abradable coating used for aircraft turbine applications and manufactured by Sulzer Metco includes agglomerates of a thermoplastic (polyester) and a dry lubricant (hexagonal boron nitride). Although the agglomerates supposedly provide abradability, the high volume of the agglomerates likely negatively affect the lifetime and integrity of the coating. Because stationary gas turbine engines often require an overhaul lifetime on the order of 30,000 hours, the Sulzer Metco abradable coating would not be durable in stationary gas turbine engines.

The present disclosure is directed at overcoming one or more of the problems set forth above.

SUMMARY OF THE DISCLOSURE

In one aspect of the present disclosure, an apparatus includes a housing that has a plurality of temperatures sections including a 950–1500° F. section. At least one rotating blade row is positioned within the 950–1500° F. section and includes a surface that is, at least in part, comprised of a relatively non-abradable material. A shroud surface of the 950–1500° F. section is, at least in part, comprised of a relatively non-abradable material. The shroud surface is covered by a relatively abradable coating that includes a metallic matrix and at least one of a thermoplastic and a dry lubricant. The metallic matrix is 55–85% of the coating by volume.

In another aspect of the present disclosure, a 950–1500° F. turbine section housing includes a body including a shroud surface that is comprised, at least in part, of a relatively non-abradable material. The shroud surface is covered by a 950–1500° F. relatively abradable coating that includes a metallic matrix and at least one of a thermoplastic and dry lubricant. The metallic matrix is 55–85% of the coating by volume.

DETAILED DESCRIPTION

Figure 1:
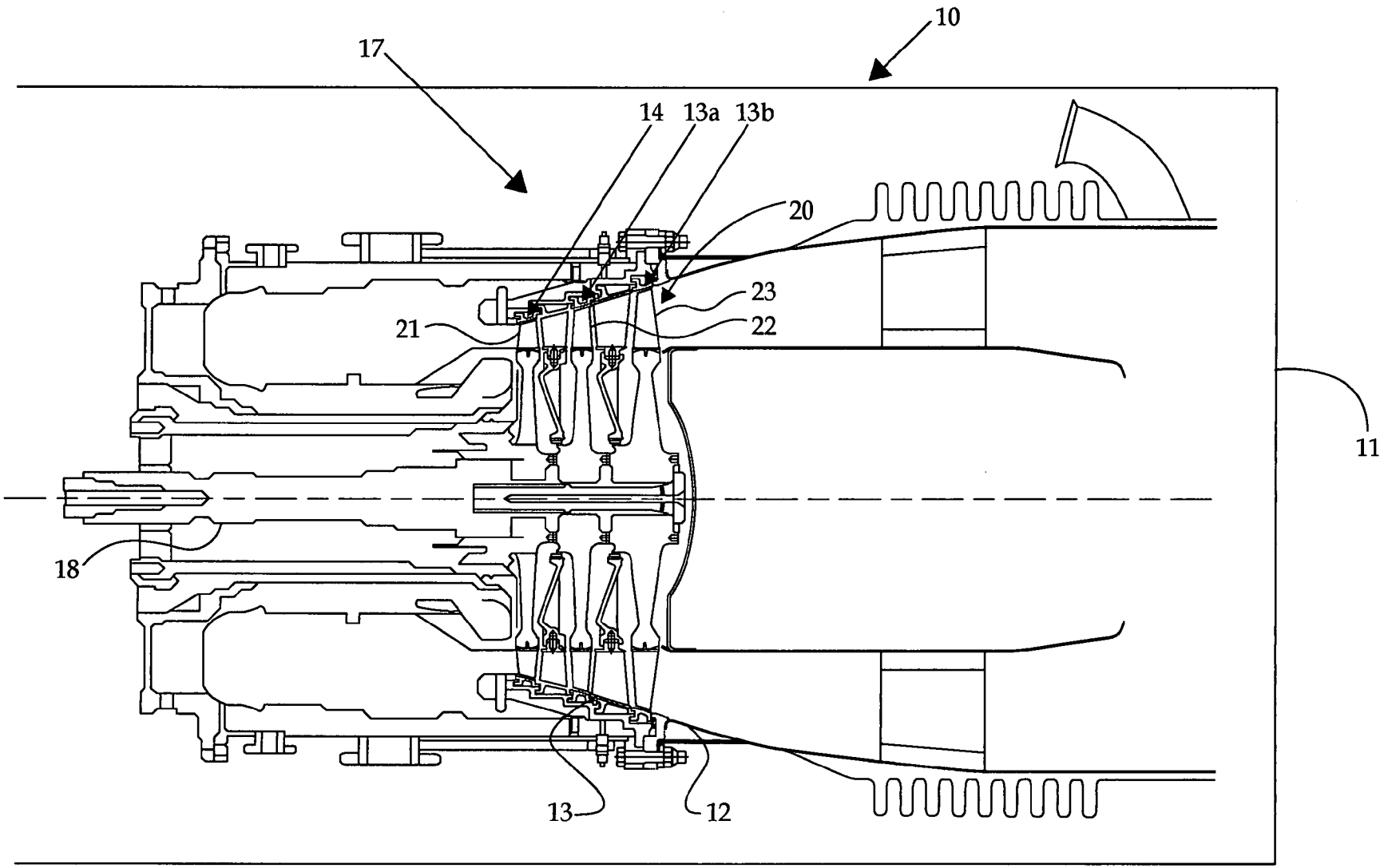
FIG. 1 is a partial cross-sectioned diagrammatic view of a turbine engine, according to the present disclosure.

Referring to FIG. 1, there is shown a cross-sectioned view of a turbine engine 10, according to the present disclosure. The turbine engine 10, being an apparatus, is preferably a land-based gas turbine engine. The turbine engine 10 includes a compressor section (not shown) and a combustion section (not shown) both upstream from a turbine section 17. Ambient air is drawn into the compressor section of the turbine engine 10 where it is compressed. The compressed air is combined with fuel and burned in the combustion section. The high pressure and high temperature exhaust gases from the combustion drive a turbine 20 positioned within the turbine section 17 that is operably coupled to the compressor via a central shaft 18. The turbine engine 10 includes an engine housing 11 to which a turbine section housing 12, herein referred to as a shroud, is attached.

The turbine section housing 12 includes a plurality of temperature sections including a 950–1500° F. section 13. In the illustrated example, the turbine section housing 12 includes a first section 14, being a 1500–1700° F. section (this section could be up to 1900° F.) 8, and the 950–1500° F. section preferably includes a second section 13*a*, being a 1300–1500° F. section, and a third section 13*b*, being a 950–1300° F. section. The turbine 20 also includes first, second and third turbine stages 21, 22 and 23 adjacent to the first, second and third sections 14, 13*a* and 13*b* of the turbine section housing 12, respectively. Each turbine stage 21, 22 and 23 is illustrated as including one row of seventy turbine blades. However, those skilled in the art will appreciate that the number of turbine blades in each row can vary. The first turbine stage 21 typically operates around 1500° F. The second turbine stage 22 typically operates around 1350° F., although can be subject to temperatures up to 1500° F. The third turbine stage 23 typically operates around 950° F., although can be subjected to temperatures up to 1300° F.

Figure 2:
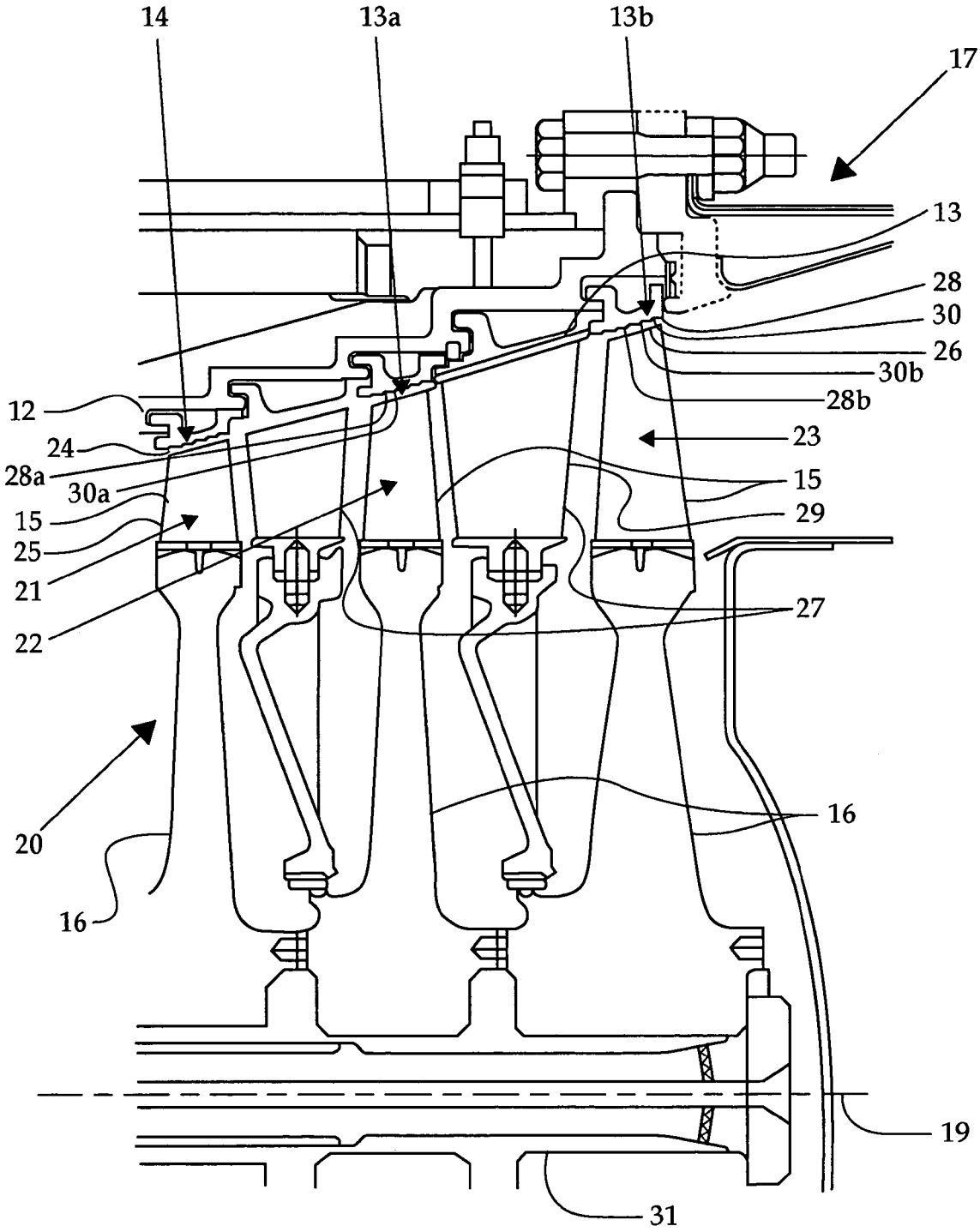
FIG. 2 is a cross sectioned view of three turbine stages within a turbine section housing of the turbine engine of FIG. 1; and Table I is a comparison of commercially available coatings and a relatively abradable coatings covering the turbine section housing of FIG. 2.

Referring to FIG. 2, there is shown a cross sectioned view of the first, second and third turbine stages 21, 22 and 23 within the shroud 12 of the turbine engine 10 of FIG. 1. The turbine 20 includes a plurality of rotating blades 15 operably coupled to either the central shaft 18 (shown in FIG. 1) or an output shaft 31 via a plurality of rotors. Those skilled in the art will appreciate that the blades 15 can be integral with the rotor 16 or attached to the rotors 16. The shafts 18 and 31 and the rotor 16 are coaxial about a central axis 19. Each blade 15 includes a tip portion 24, a base portion 25 that is adjacent to the rotor 16, and a surface 26 that is, at least in part, comprised of a relatively non-abradable material. In the illustrated example, the tip portion 24 includes the surface 26 made from the relatively non-abradable material, including, but not limited to, various metal alloys. The shroud 12 includes a plurality of vanes 27 that extend inwardly from the shroud 12 and towards the shaft 18. The vanes 27 separate the rows of blades 15 from one another. Exhaust gases can enter the turbine section 17 via at least one nozzle 29.

The 950–1500° F. section 13 of the shroud 12 includes a shroud surface 28 that is comprised, at least in part, of a relatively non-abradable material, including but not limited to, various metal alloys. In the illustrated example, the shroud surface 28 is serrated. However, those skilled in the art will appreciate that the shroud surface could be flat. Preferably, the shroud surface 28 includes a 950–1300° F. shroud surface 28*b* in the 950–1300° F. section 13*b*, and a 1300–1500° F. shroud surface 28*a* in the 1300–1500° F. section 13*a*. A relatively abradable coating 30 covers the shroud surface 28. Preferably, a 950–1300° F. abradable coating 30*b* covers the 950–1300° F. shroud surface 28*b*, and a 1300–1500° F. abradable coating 30*a* covers the 1300–1500° F. shroud surface 28*a*. It should be appreciated that the 1300–1500° F. coating 30*a* may also be applied to the shroud surface 28 within the first section 14 of the shroud 12.

The relatively abradable coating 30 includes a metallic matrix and at least one of a thermoplastic and dry lubricant. The metallic matrix can range between 55–85% of the abradable coating 30 by volume. Although the remaining volume of the coating 30 can include either the thermoplastic or the dry lubricant, the remaining volume preferably includes an agglomerate of the thermoplastic and the dry lubricant. Although various thermoplastics and dry lubricants may be used, preferably polyester and hexagonal boron nitride are included within the coating 30. Because hexagonal boron nitride is relatively fragile, the hexagonal boron nitride-polyester agglomeration serves to encase and protect the hexagonal boron nitride.

The metallic matrix is preferably either CoNiCrAlY or NiCrAlY. If NiCrAlY is used, the percentage of nickel and aluminum is increased to compensate for the omission of cobalt from the matrix. Specifically, the powder composition of the metallic matrix, by weight, can include 36–38% cobalt, 29–32% nickel, 18–20% chromium, 6–8% aluminum, and 0.2–0.5 percent yttrium. Alternatively, the powder composition of the metallic matrix, by weight, might include 65–69% nickel, 18–22% Chromium, 6–12% aluminum, and 0.2–0.5% yttrium. The metallic matrix provides structural integrity and oxidation resistance to the coating 30. Both coating compositions include 3–6% polyester-0.8–1.6% hexagonal boron nitride, resulting in 15–40% agglomerates, by volume of the coating 30. Although the present disclosure contemplates the coating 30 including up to 45% agglomerate, by volume, preferably the agglomerate is 15–40% of the coating 30, by volume. Those skilled in the art will appreciate that polyester-hexagonal boron nitride agglomerate is usually present in commercially available powders having the pre-determined ratio of 6/1.6 or 3/0.8, respectively. Preferably, the relatively abradable coating 30*a* covering the 1300–1500° F. shroud surface 28*a* includes 15–25% polyester-hexagonal boron nitride agglomerate by volume, and the relatively abradable coating 30*b* covering the 950–1300° F. shroud surface 28*b* includes 25–35% polyester-hexagonal boron nitride agglomerate by volume. It should be appreciated that, rather than including the agglomerates, the 1300–1500° F. coating 30*a* could include either 15–25% polyester or 15–25% hexagonal boron nitride, and the 950–1300° F. coating 30*b* could include either 25–35% polyester or 25–35% hexagonal boron nitride.

Although the coating 30 may be applied by various methods, the relatively abradable coating 30 is preferably either a plasma-sprayed or wire arc-sprayed coating. Preferably, the plasma-spray abradable coating 30 is not machined after being sprayed. Those skilled in the art will appreciate that both the plasma-spray and arc-spray method are known in the art, and that a wire for the wire arc-sprayed coating can be manufactured. According to the preferred embodiment, the wire would include an agglomerated polyester-hexagonal boron nitride within a sheet of either CoNiCrAlY or NiCrAlY alloy wire. Although the thickness of the coating 30 can vary, the coating 30 should be sufficiently thick to provide contact between the abradable coating and the blade that will result in abrading away of some, but not all, of the coating. Some of the coating 30 remains to protect the shroud 12 from oxidation and corrosion. Further, those skilled in the art will appreciate that a bonding coat of the metallic matrix is preferably applied between the shroud surface 28 and the abradable coating 30.

Referring to Table I, there is shown a comparison of the relatively abradable coatings 30*a* and 30*b* and commercially available coatings 1 and 2. The comparisons were made based on results of rub-rig tests and oxidation tests. Those skilled in the art will appreciate that the change in blade weight and spike temperatures determined from rub-rig tests can illustrate abradability characteristics of coatings 30*a* and 30*b*. The change in blade weight occurs from material interchange and loss during rubbing, and is a result of relative abradability. The blade weight change (loss) for the 950–1300° coating 30*b* at 1000° F. and 1350–1500° coating

30*a* at 1350° F. and 1500° F. were minimal. Further, the change in blade weight decreased with the rise in temperature.

The temperature spike refers to the temperature rise during rubbing measured in the shroud 12. Higher temperature spikes can be a product of a more abundant release of friction heat that is a result of coating hardness and relative abradability. The temperature spikes of the coatings 30*b* and 30*a* and the commercial coating 1 decrease with the rise in operation temperatures. Hexagonal-boron nitride does not act as a solid lubricant at low temperatures. However, at higher temperatures, hexagonal-boron nitride oxides, and its oxidation products can act as dry lubricants. Those skilled in the art will appreciate that the oxidation products are thermodynamically favored from 392° F., and above 932° F., there is accelerated oxidation. Around 1112° F., $B_2O_3$ volatilizes. Thus, commercial coating 1 which includes approximately 80% polyester-boron nitride agglomerates, by volume, produces relatively higher temperature spikes at 1000° F., and lower temperature spike at 1500° F.

Although the oxidation of hexagonal-boron nitride provided good abradability characteristics at 1500° F., 950–1300° F. coating 30*b* had better abradability at 1000° F. than commercial coating 1. Further, the 80% agglomerates, by volume, of commercial coating 1 may reduce the coating's bond strength to the substrate to the point where it negatively affects the coating's life and integrity. Although commercial coating 1 exhibited an acceptable rub at 65° F., coating 1 exhibited integrity problems at 1000° and 1500° F., and thus, could not withstand temperatures of 1000° F. and above for extended time periods, such as 30,000 hours. The rub caused excessive damage to the top layers of the coating.

Those skilled in the art will appreciate that oxidation resistant characteristics can be illustrated by the change in weight and thickness of the coating over time. In a cyclic oxidation test at 950° F. for 5000 hours, commercial coating 1 lost approximately three times the weight as the 950–1350° F. coating 30*b* (results not shown in Table I). Further, in cyclic oxidation tests at 1500° F. for 1,000 hours, commercial coating 1 failed by cracking, while 1350–1500° F. coating 30*a* showed no signs of distress or failure for 10,000 hours. Commercial coating 2 exhibited excellent oxidation resistance at 1350° F. and 1500° F., illustrated by its predicted low change in weight after 30,000 hours at 1350° F. and 1500° F. However, commercial coating 2 includes only CoNiCrAlY without any agglomerates that can provide abradability characteristics.

Thus, due to the relatively large percentage of polyester-hexagonal boron nitride in the commercial coating 1, coating 1 may provide good abradability at 1500° F., but lacks structural integrity to last 30,000 hours in harsh turbine environments. Commercial coating 2 is oxidation resistant, but lacks any abradability characteristics. However, both the 950–1300° F. coating 30*b* and the 1300–1500° F. coating 30*a* provide good abradability as illustrated by their relatively low change in blade weight and temperature spikes at their desired operating temperatures, and good integrity and oxidation resistance, illustrated by their relatively low predicted change in weight after 30,000 hours at 1350° F.

INDUSTRIAL APPLICABILITY

Referring to FIGS. 1–2, the operation of the present disclosure will be discussed for the land-based turbine engine 10. However, those skilled in the art should appreciate that the present disclosure would operate similarly in any apparatus with rotating blades subjected to temperatures between 950–1500° F. During a break-in period of the turbine 20 and when the turbine 20 is operating at relatively low temperatures and loads, the outer tips 24 of the rotating blades 15 can rotate without making contact with the coatings 30*a* and 30*b* on the shroud surface 28*a* and 28*b*, respectively. The turbine 20 is designed such that there is a minimal clearance between the rotating blades 15 and the shroud 12. However, when the turbine 20 is operating at relatively high temperatures and/or loads during the break-in period, the expansion of the blades 15 will cause the relatively non-abradable surface 26 of the rotating blades 15 to make contact with the relatively abradable coatings 30*a* and 30*b*. The relatively non-abradable surface 26 will wear away the relatively abradable coatings 30*a* and 30*b* until grooves are formed in which the blades 15 can rotate without contact. Thus, the clearance between the shroud surface 28 and the blades 15 is no larger than necessary. The flow of the gases around the turbine 20 is limited, and the efficiency of the turbine 20 is increased. However, some of the abradable coating 30*a* and 30*b* will remain in order to protect the shroud surfaces 28*a* and 28*b* from high temperature oxidation and corrosion. Because the relatively abradable coatings 30*a* and 30*b* include 75–85% and 65–75% of the metallic matrix by volume, respectively, the coatings 30*a* and 30*b* have sufficient oxidation resistance and structural integrity in order to protect the shroud surfaces 28*a* and 28*b* for, at least, 30,000 hours. Further, because of the balance between the abradable material and the metallic matrix within the coatings 30*a* and 30*b*, the coatings 30*a* and 30*b* should not be damaged during rubbing with the blades 15.

The present disclosure is advantageous because it provides a good compromise between coating integrity, abradability and oxidation resistance for relatively long-term application, such as in land-based turbine engines, between 950–1500° F. Whereas the agglomerates provide abradability between 950–1500° F., the metallic matrix provides oxidation resistance and structural integrity. Thus, superficial layers of the coatings 30*a* and 30*b* can abrade away without damaging the blades 15, while the rest of the coatings 30*a* and 30*b* can remain in order to protect the shroud 12. If there is too much polyester-hexagonal boron nitride agglomerates, they can affect the integrity of the coating. However, if there are no agglomerates, then there will be no abradability characteristics to the coating. The amounts of the agglomerates and the metallic matrix can be adjusted for different low to mid temperatures. The greater the temperature, the more metallic matrix needed for oxidation and heat resistance.

Because the coatings 30*a* and 30*b* have structural integrity and provide abradability and oxidation resistance, the coatings 30*a* and 30*b* can be used for extended periods of times. Therefore, the coatings 30*a* and 30*b* can find use in land-based turbine engines that are not subjected to frequent overhauls.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. An apparatus comprising:

a housing including a plurality of temperature sections that includes a 950° to 1500° F. section, and the 950° to 1500° F. section including a shroud surface being, comprised of a non-abradable material;

at least one rotating blade row being positioned within the 950° to 1500° F. section, and including a surface being, at least in part, comprised of a relatively non-abradable material; and a relatively abradable coating covering at least a portion of the shroud surface of the 950° to 1500° F. section, and including a metallic matrix being 55–85% of the coating by volume and at least one of a thermoplastic and a dry lubricant; and the relatively abradable coating on a lower temperature portion of the 950° to 1500° F. section having a different proportion of the at least one of a thermoplastic and a dry lubricant than the relatively abradable coating on a higher temperature portion of the 950° to 1500° F. section.

2. The apparatus of claim 1 wherein the metallic matrix includes at least one of CoNiCrAlY and NiCrAlY.

3. The apparatus of claim 1 wherein the thermoplastic includes polyester.

4. The apparatus of claim 1 wherein the dry lubricant includes hexagonal boron nitride.

5. The apparatus of claim 1 wherein the relatively abradable coating being at least one of a plasma-sprayed coating and an arc-sprayed coating.

6. The apparatus of claim 1 wherein the relatively abradable coating includes an agglomerate of the thermoplastic and dry lubricant.

7. The apparatus of claim 1 including a land-based turbine engine.

8. An apparatus comprising:

a housing that is a portion of a land-based turbine engine including a plurality of temperature sections that includes a 950° to 1500° F. section, and the 950° to 1500° F. section including a shroud surface being, comprised of a non-abradable material;

at least one rotating blade row being positioned within the 950° to 1500° F. section, and including a surface being, at least in part, comprised of a relatively non-abradable material;

a relatively abradable coating covering at least a portion of the shroud surface of the 950° to 1500° F. section, and including a metallic matrix being 55–85% of the coating by volume and at least one of a thermoplastic and a dry lubricant;

wherein the 950°–1500° F. section includes a 1300°–1500° F. section and a 950°–1300° F. section, and the shroud surface includes a 1300°–1500° F. shroud surface and a 950°–1300° F. shroud surface; and the relatively abradable coating covering at least a portion of the 1300°–1500° F. shroud surface includes 15–25% polyester-hexagonal boron nitride agglomerate by volume.

9. An apparatus comprising:

a housing that is a portion of a land-based turbine engine including a plurality of temperature sections that includes a 950° to 1500° F. section, and the 950° to 1500° F. section including a shroud surface being, comprised of a non-abradable material;

at least one rotating blade row being positioned within the 950° to 1500° F. section, and including a surface being, at least in part, comprised of a relatively non-abradable material;

a relatively abradable coating covering at least a portion of the shroud surface of the 950° to 1500° F. section, and including a metallic matrix being 55–85% of the coating by volume and at least one of a thermoplastic and a dry lubricant;

wherein the 950°–1500° F. section includes a 1300°–1500° F. section and a 950°–1300° F. section, and the shroud surface includes a 1300°–1500° F. shroud surface and a 950°–1300° F. shroud surface; and the relatively abradable coating covering at least a portion of the 950°–1300° F. shroud surface includes 25–35% polyester-hexagonal boron nitride agglomerate by volume.

10. An apparatus comprising:

a housing including a plurality of temperature sections that includes a 950° to 1500° F. section, and the 950° to 1500° F. section including a shroud surface being, comprised of a non-abradable material;

at least one rotating blade row being positioned within the 950° to 1500° F. section, and including a surface being, at least in part, comprised of a relatively non-abradable material;

a relatively abradable coating covering at least a portion of the shroud surface of the 950° to 1500° F. section, and including a metallic matrix being 55–85% of the coating by volume and at least one of a thermoplastic and a dry lubricant;

wherein the relatively abradable coating includes 65–69% nickel, 18–22% chromium, 6–12% aluminum, 0.2–0.5% yttrium, 3–6% polyester, and 0.8–1.6% hexagonal boron nitride.

11. An apparatus comprising:

a housing including a plurality of temperature sections that includes a 950° to 1500° F. section, and the 950° to 1500° F. section including a shroud surface being, comprised of a non-abradable material;

at least one rotating blade row being positioned within the 950° to 1500° F. section, and including a surface being, at least in part, comprised of a relatively non-abradable material;

a relatively abradable coating covering at least a portion of the shroud surface of the 950° to 1500° F. section, and including a metallic matrix being 55–85% of the coating by volume and at least one of a thermoplastic and a dry lubricant;

wherein the relatively abradable coating includes 36–38% cobalt, 29–32% nickel, 18–20% chromium, 6–8% aluminum, 0.2–0.5% yttrium, 3–6% polyester and 0.8–1.6 hexagonal boron nitride.

12. The apparatus of claim 11 includes a land-based turbine engine;

the relatively abradable coating being a plasma-sprayed coating and includes a polyester-hexagonal boron nitride agglomerate; and the 950°–1500° F. section of a turbine housing includes a 1300°–1500° F. section that includes a 1300°–1500° F. shroud surface and a 950°–1300° F. section that includes a 950°–1300° F. shroud surface, and the relatively abradable coating covering at least a portion of the 1300°–1500° F. shroud surface includes 15–25% polyester-hexagonal boron nitride agglomerate by volume, and the relatively abradable coating covering at least a portion of the 950°–1300° F. shroud surface includes 25–35% polyester-hexagonal boron nitride agglomerate by volume.

13. A 950°–1500° F. turbine section housing, comprising:

a body including a shroud surface being comprised, at least in part, of a relatively non-abradable material; and a 950°–1500° F. relatively abradable coating covering at least a portion of the shroud surface of the body, and including a metallic matrix being 55–85% of the coating by volume and at least one of a thermoplastic and a dry lubricant; and the relatively abradable coating on a lower temperature portion of the 950° to 1500° F. section having a different proportion of the at least one of a thermoplastic and a dry lubricant than the relatively abradable coating on a higher temperature portion of the 950° to 1500° F. section.

14. The 950°–1500° F. turbine section housing of claim 13 wherein the 950°–1500° F. relatively abradable coating includes an agglomerate of the thermoplastic and the dry lubricant.

15. The 950°–1500° F. turbine section housing of claim 14 wherein the metallic matrix includes at least one of CoNiCrAlY and NiCrAlY, the thermoplastic includes polyester, and the dry lubricant includes hexagonal boron nitride.

16. A 950°–1500° F. turbine section housing, comprising:

a body including a shroud surface being comprised, at least in part, of a relatively non-abradable material;

a 950°–1500° F. relatively abradable coating covering at least a portion of the shroud surface of the body, and including a metallic matrix being 55–85% of the coating by volume and at least one of a thermoplastic and a dry lubricant;

wherein the 950°–1500° F. relatively abradable coating includes an agglomerate of the thermoplastic and the dry lubricant;

wherein the metallic matrix includes at least one of CoNiCrAlY and NiCrAlY, the thermoplastic includes polyester, and the dry lubricant includes hexagonal boron nitride;

wherein the body includes a 1300°–1500° section and a 950°–1300° F. section, and the shroud surface of the body includes a 1300°–1500° F. shroud surface and a 950°–1300° F. shroud surface; and the relatively abradable coating covering at least a portion of the 1300°–1500° F. shroud surface includes 15–25% polyester-hexagonal boron nitride agglomerate by volume.

17. The 950°–1500° F. turbine section housing of claim 16 wherein the relatively abradable coating covering at least a portion of the 950°–1300° shroud surface includes 25–35% polyester-hexagonal boron nitride agglomerate by volume.

18. The 950°–1500° F. turbine section housing of claim 17 wherein the relatively abradable coating includes 65–69% nickel, 18–22% chromium, 6–12% aluminum, 0.2–0.5% yttrium, 3–6% polyester, and 0.8–1.6% hexagonal boron nitride.

19. The 950°–1500° F. turbine section housing of claim 17 wherein the relatively abradable coating includes 36–38% cobalt, 29–32% nickel, 18–20% chromium, 6–8% aluminum, 0.2–0.5% yttrium, 3–6% polyester, and 0.8–1.6 hexagonal boron nitride.

20. The 950°–1500° F. turbine section housing of claim 19 wherein the relatively abradable coating being at least one of a plasma-sprayed coating and an arc-sprayed coating.

* * * * *

UNITED STATES PATENT AND TRADEMARK OFFICE

CERTIFICATE OF CORRECTION

PATENT NO. : 7,165,946 B2
APPLICATION NO. : 10/872609
DATED : January 23, 2007
INVENTOR(S) : Michael A. Coe et al.

It is certified that error appears in the above-identified patent and that said Letters Patent is hereby corrected as shown below:

Drawings:

Table 1 should be page 3 of the drawings.

Signed and Sealed this

Eighth Day of May, 2007

JON W. DUDAS
*Director of the United States Patent and Trademark Office*

| | 30a | 30b | Commercial 1 | Commercial 2 |
|---|---|---|---|---|
| Composition | CoNiCrAlY-PE/h-BN | CoNiCrAlY-PE/h-BN | CoNiCrAlY-PE/h-BN | CoNiCrAlY |
| % PE/h-BN by volume | 15 - 25% | 25 - 35% | 70 - 80% | 0% |
| Bond Strength (psi) | 5000 - 6000 | 5000 - 6000 | 2000 | > 6000 |
| Hardness (HRG) | 50 | 40 | < 0 | 75 |
| Rub-rig test Change in blade Weight (%) | | | | |
| at 65° F | 0.25g | 0.15g (0.4%) | — | — |
| at 1000° F | — | (0.2%) | 0.11g (0.3%) | — |
| at 1350° F | 0.11g | — | — | — |
| at 1500° F | 0.06g | — | 0.088g (0.3%) | — |
| Rub-rig test Temp. spike (% of test temperature) | | | | |
| at 65° F | 23% | 42% | — | — |
| at 1000° F | — | 12% | 35% | — |
| at 1350° F | 19% | — | — | — |
| at 1500° F | 17% | — | 7% | — |
| Oxidation test Estimated Predicted Change in weight After 30,000 h at 1350° F (mg/cm²) | — | 131 | — | 105 |
| Oxidation test Estimated Predicted Change in weight After 30,000 h at 1500° F (mg/cm²) | — | 256 | Failed by cracking | 109 |
| Oxidation test Estimated Predicted Change in weight After 1500 h at 950° F (mg/cm²) | — | 4.5 | 12.6 | — |

Table 1